US007884332B1

(12) United States Patent
DeVito

(10) Patent No.: US 7,884,332 B1
(45) Date of Patent: Feb. 8, 2011

(54) RADIATION DETECTOR

(75) Inventor: Raymond DeVito, North Logan, UT (US)

(73) Assignee: Utah State University, Logan, UT (US)

( * ) Notice: Subject to any disclaimer, the term of this patent is extended or adjusted under 35 U.S.C. 154(b) by 0 days.

(21) Appl. No.: 12/616,665

(22) Filed: Nov. 11, 2009

(51) Int. Cl.
*H01J 47/00* (2006.01)

(52) U.S. Cl. ..... 250/375

(58) Field of Classification Search ..... 250/375
See application file for complete search history.

(56) References Cited

U.S. PATENT DOCUMENTS 4,105,917 A * 8/1978 McIver et al. ..... 250/291

OTHER PUBLICATIONS

P.N. Luke, "Single-polarity charge sensing in ionization detectors using coplanar electrodes," 1994, Applied Physics Letters, vol. 65, No. 22, pp. 2884-2886.*

* cited by examiner

*Primary Examiner*—David P Porta
*Assistant Examiner*—Kiho Kim

(57) ABSTRACT

An ionization detector having a grid of electrodes disposed perpendicular to an oscillating voltage. Charge released from an ionization event oscillates in the detector medium at the same frequency as the applied oscillating voltage. The electrode grid is configured to measure induced oscillating charge from the oscillating ionization charge in the detector. The detector signal is obtained from readout of the induced oscillating charge on the electrodes. Signal processing electronics processes the measured signal from the oscillating induced charge to derive energy and position information of the ionization event. A bias voltage is applied across the detector to further sweep the ionization charge from the active detection volume.

19 Claims, 5 Drawing Sheets

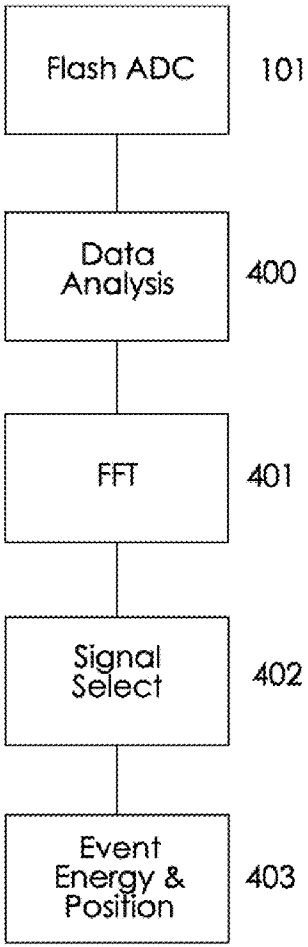
FIG. 4
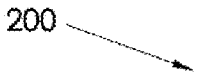

RADIATION DETECTOR

TECHNICAL FIELD

The present invention relates to radiation detection, and more specifically to ionization detectors.

BACKGROUND

Ionization detectors measure radiation by means of the number of charge carriers set free in the detector. The active detection volume is typically arranged between two electrodes. Ionizing radiation produces free electrons and holes within the detector material, often a semiconductor. The number of electron-hole pairs is proportional to the energy transmitted by the radiation to the semiconductor. As a result, a number of electrons are transferred from the valence band to the conduction band, and an equal number of holes are created in the valence band. Under the influence of an electric field, electrons and holes travel to the electrodes, where they result in a pulse that can be measured. The holes travel in the opposite direction and can also be measured. As the amount of energy required to create an electron-hole pair is known, and is mostly independent of the energy of the incident radiation, measuring the number of electron-hole pairs allows the energy of the incident radiation to be determined.

Radiation detectors using simple planar electrodes and based on ionization measurements often suffer from poor collection of charge carriers. For example, positive charge carriers (holes) may migrate through the detector medium at a much slower rate than negative charge carriers (electrons). As a result, such detectors produce signals that vary in amplitude depending on the location within the detector at which incident radiation interacts with the detector medium. Such detectors include, but are not limited to, semiconductor detectors, liquid ionization detectors, and gas ionization detectors.

In a simple planar electrode ionization detector, full-area electrodes are formed on two opposing faces of the detector medium. A bias voltage applied across the two electrodes provides an electric field to separate and collect the charge carriers that are created by the absorption of radiation in the detector medium. Induced charge signal on one of the electrodes due to the motion of carriers provides a measure of the energy of the radiation. Incomplete charge collection due to carrier trapping or slow carrier transport results in reduced signals, which vary in strength depending on the depth of radiation interaction. This degrades the energy resolution of the detector.

Several detector structures make use of the concept of multiple electrode collection to minimize the detrimental effects of charge trapping. Rather than trying to force better collection of the holes, a number of practitioners have taken the approach to design devices in which the signal due to the holes is relatively insignificant.

Ramo's Theorem explains the effect on the spectrum that occurs in devices with uniform and with non-uniform electric fields. In a planar device with full area electrodes, the electric field is uniform throughout the device. A device with a very small point electrode will have a field that increases rapidly close to that electrode. Thus, when the electron is close to the electrode, it will pass through a higher electric field and generate a larger signal in the electrode. The simple planar device has a uniform field and in the general case where the electrodes are large compared to the volume occupied by the electric charge the response at all points in the device is linear. Thus, all of the electrons and all of the holes contribute to the detected signal.

SUMMARY OF THE INVENTION

An ionization detector is disclosed having a grid of electrodes disposed perpendicular to an oscillating voltage. Charge released from an ionization event oscillates in the detector medium at the same frequency as the applied oscillating voltage. The electrode grid is configured to measure induced oscillating charge from the oscillating ionization charge in the detector. The detector signal is obtained from readout of the induced oscillating charge on the electrodes. Signal processing electronics processes the measured signal from the oscillating induced charge to derive energy and position information of the ionization event. The induced signal on the collecting electrodes is utilized for signal processing. As in the planar electrode detector, a bias voltage is applied across the detector perpendicular to the oscillating voltage to further separate and sweep the ionization charge from the active detection volume.

The disclosed detector configuration works for all ionization detectors. It functions effectively on detectors in which the collection efficiency of one polarity type of carriers is significantly worse than that of the opposite polarity type. This situation occurs in many types of detectors, such as semiconductors (e.g. Ge, Si) compound semiconductor detectors (e.g. CdTe, CdZnTe, $HgI_2$), gas ionization detectors and liquid ionization detectors, where the positive carriers (holes or ions) are much more poorly transported compared to the negative carriers (electrons).

DESCRIPTION OF THE FIGURES

FIG. 4 shows an example flow diagram of the data processing procedure.

DETAILED DESCRIPTION OF THE INVENTION

Figure 1:
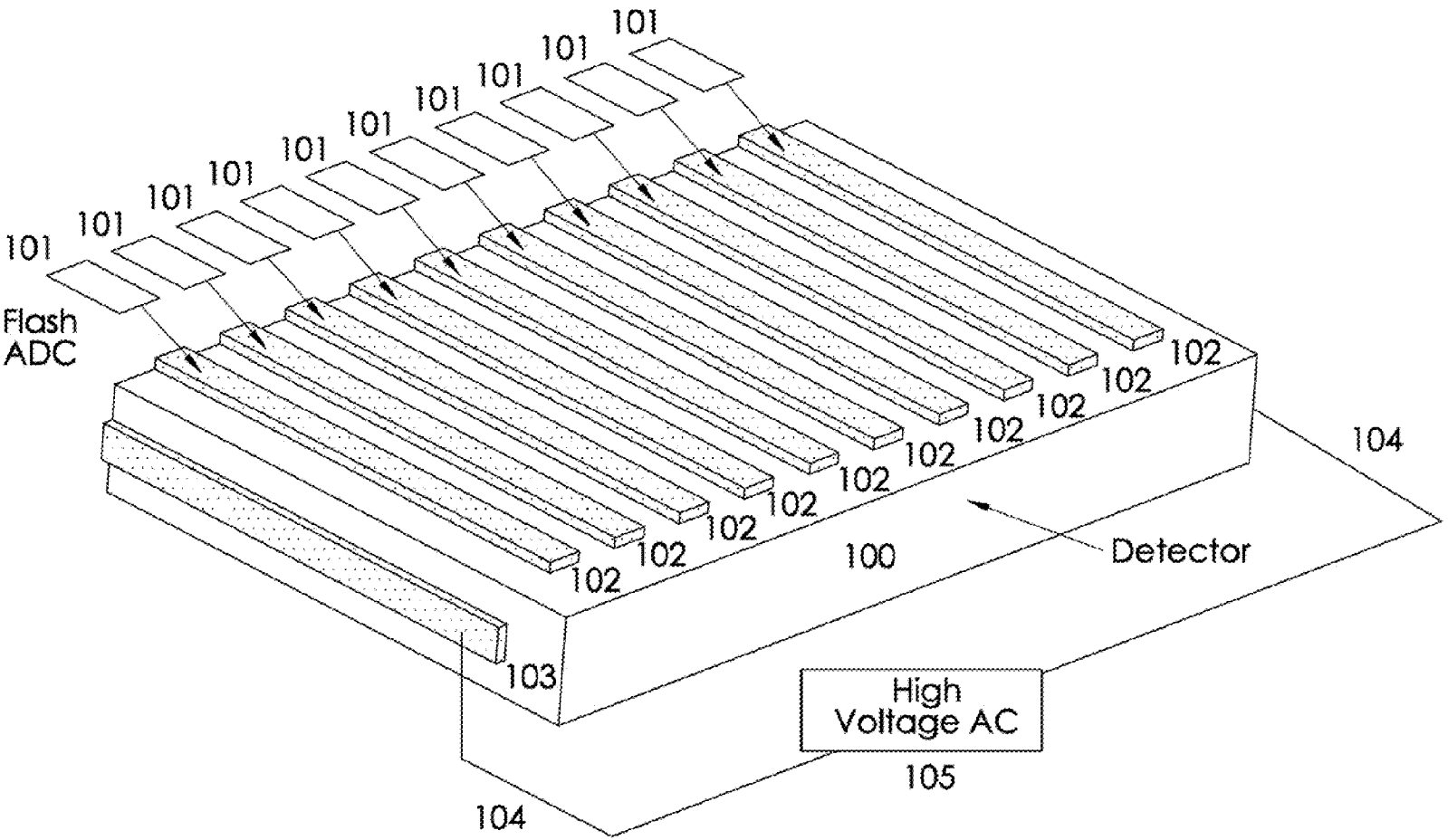
FIG. 1 shows a perspective view of one embodiment of the layout of the antenna array, AC high voltage and flash ADC readouts.
Figure 2:
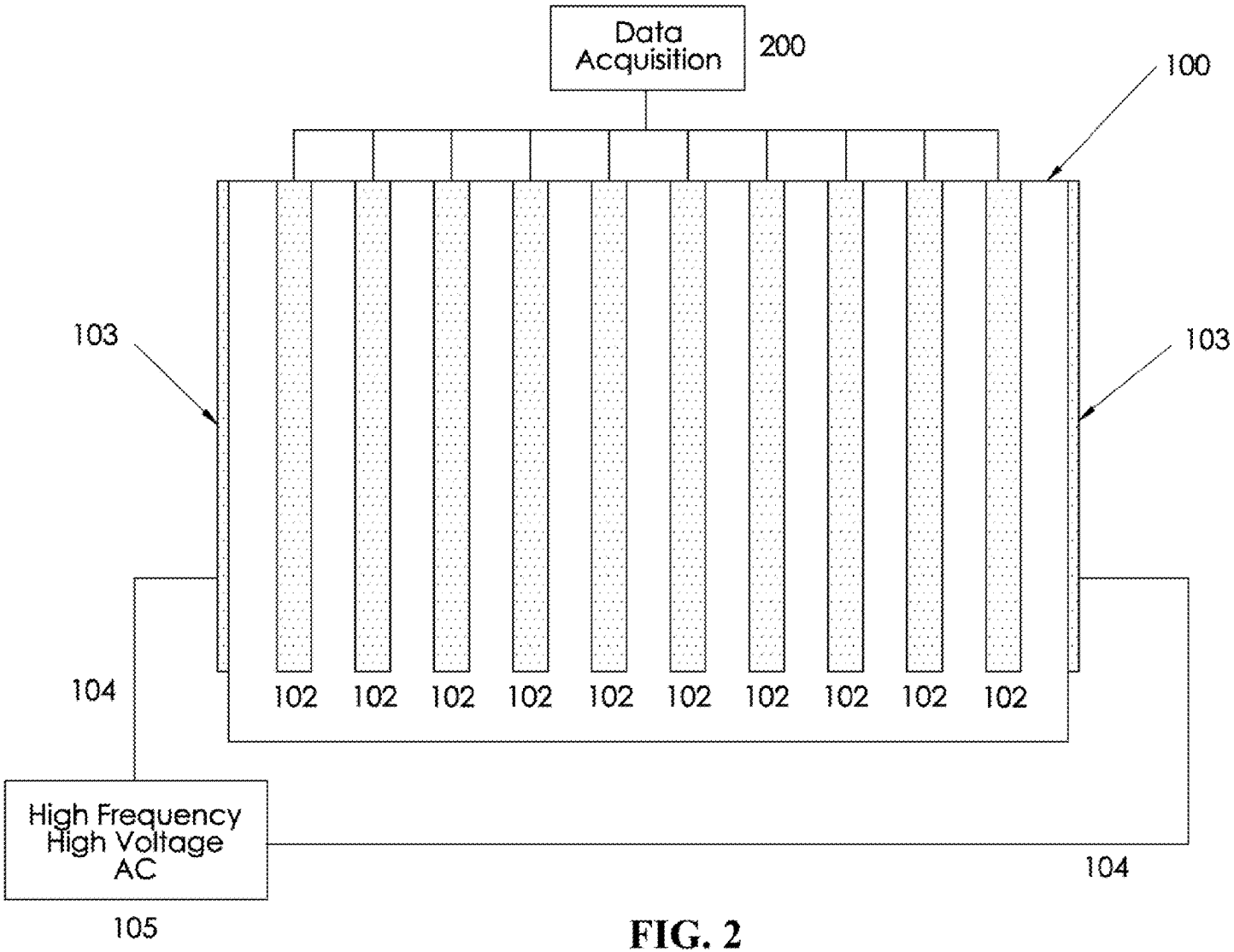
FIG. 2 shows a top view of an example of the antenna array, data acquisition and AC high voltage.
Figure 3:
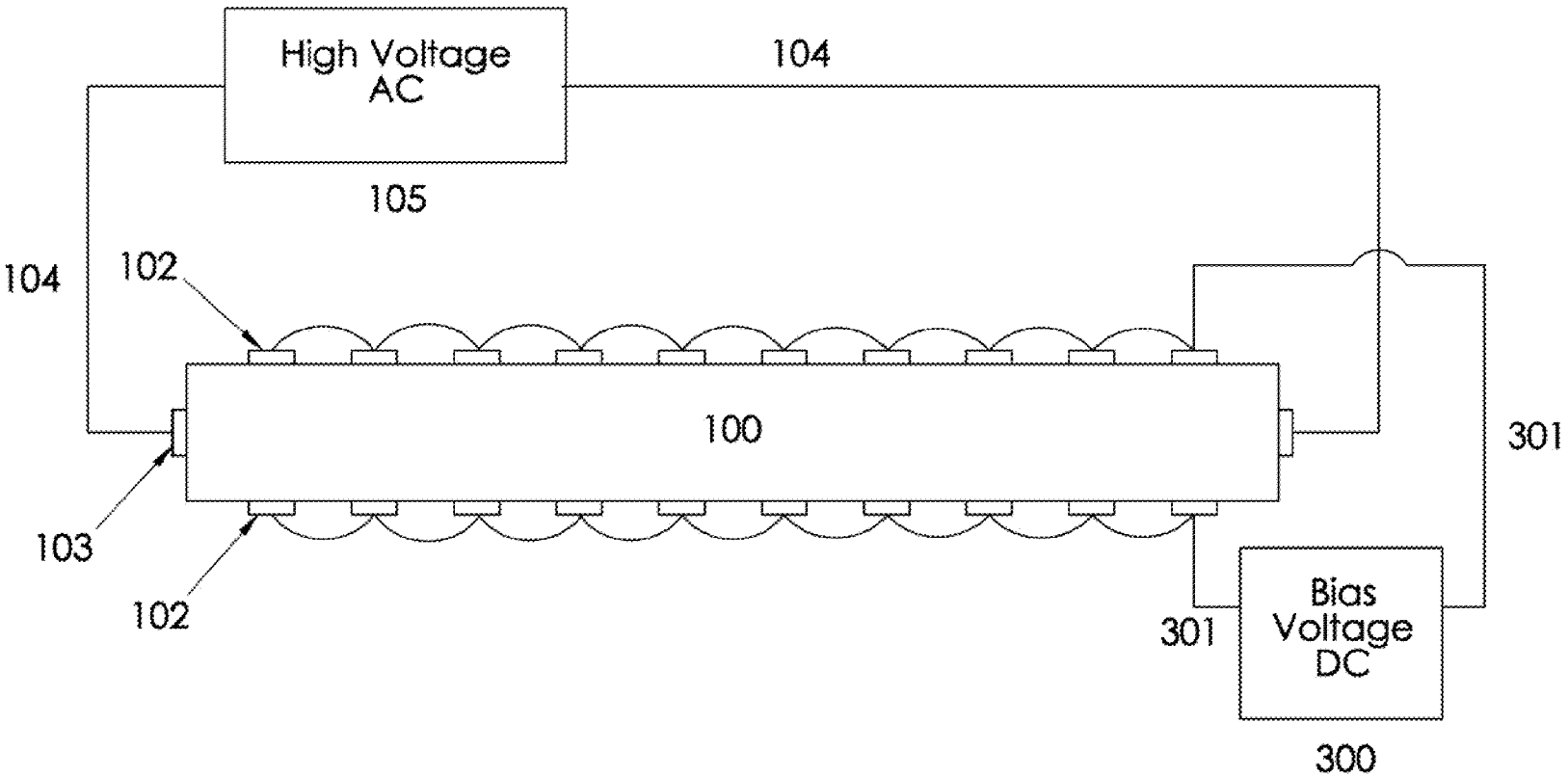
FIG. 3 shows a side view of an example of the antenna array on two sides of the detector, AC high voltage and the DC bias voltage.
Figure 5:
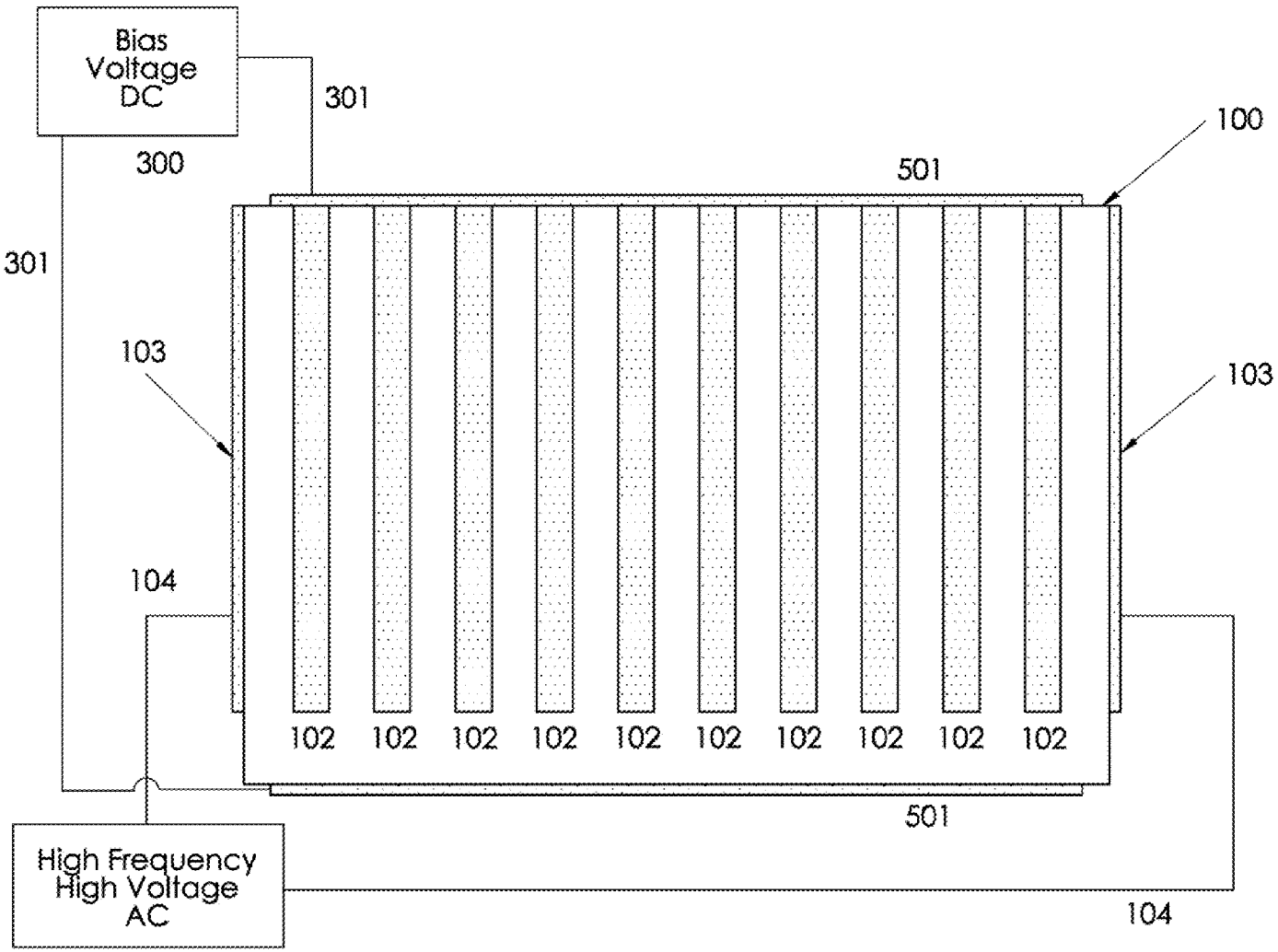
FIG. 5 shows a perspective view of an example of the layout of the antenna array, AC high voltage and DC Bias Voltage.

A radiation detector is disclosed that measures signal from an electrode grid (antenna grid) positioned perpendicular to an oscillating electric field. Upon liberation of a charge cloud from a gamma ray or other particle interaction, the charge moving in the oscillating electric field within the detector medium induces an oscillating mirror charge on the antenna array. Measuring this oscillating induced charge provides a signal dependant on the amount of moving charge, the distance from the antenna grid and the magnitude of the electric field. This induced charge measurement begins immediately, before the loss of electrons degrades the signal and mitigates the problem of material non-uniformity.

Digitized outputs from the antenna arrays 102 forms the basis for signal processing that isolates the periodic signal generated in phase with the applied oscillatory voltage from other sources of noise that have no temporal correlation with the applied voltage. Preamp noise and noise contributions from capacitive sources could be minimized using this signal processing capability. The desired signal has a known temporal oscillatory characteristic and data analysis techniques are applied to exploit this correlation, reducing the effect of uncorrelated noise.

When a charge moves in an electric field towards an electrode an image charge is created on that electrode. This image charge obeys Ramo's theorem:

$$I=E_v ev$$

where I is the instantaneous current received by the electrode due to a single electron's motion, e is the charge on the electron, v is its instantaneous velocity, and $E_v$ is the component in the direction v of that electric field which would exist at the electron's instantaneous position under the following circumstances: electron removed, given electrode raised to unit potential, all other conductors grounded. The rate at which the charge builds up is related to the electric potential and the weighting potential through which the charge is moving. The electric potential in a device is a function of the shape of the device, the position of the electrodes, and of the presence of any grid or shielding electrodes.

Cadmium Zinc Telluride CZT has superior energy resolution compared to scintillators. The theoretical limit of energy resolution for CZT is well below 1% for 662 keV. Other benefits include: smaller, lighter, more versatile detectors and systems; better position uniformity (3-D), stability and magnetic field immunity compared to PMTs; and higher count rate capability and greatly reduced pulse pile up compared to extended volume scintillators. Detector modules can be butted together with very small gaps between or around module arrays. These attributes make CZT position-sensitive detector systems compelling candidates for use in gamma-ray spectroscopy applications. Other ionization detectors can benefit from the disclosed device and method, including, but not limited to, Cadmium Telluride, Germanium, Silicon, Mercuric Iodide, liquid and gaseous ionization detectors.

Shot noise, fluctuations generated in the bulk leakage current, is an important limitation of ionization detectors. In such devices, charges making up the current move by diffusion approximately independent of each other. Shot noise from pixelated CZT detectors is much smaller than that seen in conventional planar detectors. Fluctuations in the surface leakage current are variable and depend on fabrication methods of the detector.

In one embodiment of the Radiation Detector an antenna or antenna array 102 sits on one side of a solid state detector 100. Each antenna component 102 is digitized by, for example, a flash Amplitude to Digital Converter (ADC) 101. An oscillatory voltage source 105 is attached 104 to a pair of electrodes 103 providing an internal oscillating electric field roughly perpendicular to the antenna array 102. The outputs from the flash ADCs 101 are processed in a data acquisition system 200. A DC bias voltage supply 300 is attached 301 to antenna array 102 such that the antenna array 102 maintains a bias voltage but does not allow oscillatory communication between segments of the antenna array 102. Alternatively, in another embodiment, the bias voltage can be applied on elements dispersed between the antenna elements 102, or can be configured to provide a DC voltage across the detector that is roughly perpendicular to the oscillating voltage and roughly parallel to the antenna array 102.

In another embodiment of the Radiation Detector an antenna or antenna array 102 sits on both sides of a solid state detector 100. Each antenna component 102 from each side is digitized by, for example, a flash Amplitude to Digital Converter (ADC) 101. An oscillatory voltage source 105 is attached 104 to a pair of electrodes 103 providing an internal oscillating electric field roughly perpendicular to the antenna array 102. The outputs from the flash ADCs 101 from both sides are processed in a data acquisition system 200. A DC bias voltage supply 300 is attached 301 to antenna array 102 such that the antenna array 102 maintains a bias voltage but does not allow oscillatory communication between segments of the antenna array 102 or may be applied to the same electrodes 104 used for the High voltage AC. Alternatively, in another to embodiment, the bias voltage can be applied on elements dispersed between the antenna elements 102, or electrodes can be configured to provide a DC voltage across the detector that is roughly perpendicular to the oscillating voltage and roughly parallel to the antenna array 102.

In one embodiment the signal processing proceeds by first digitizing the signal from the antenna array using a fast serial ADC such as a flash ADC 101. These outputs may be preconditioned or filtered via data analysis 400 selected for the particular application. The oscillatory signal is converted to frequency domain via, for example, a Fast Fourier Transform (FFT) module 401. The signal is selected 402 for the frequency output from the FFT 401 by choosing the frequency that matches the frequency of the applied AC voltage 105. The signal so extracted is processed 403 to obtain the energy and/or position information of the event.

In this detector at least one linear antenna is used. Alternatively an array of linear antennas 102 is employed. With this arrangement, the signal induced on each antenna 102 is mainly proportional to the number of electrons. This reduces the effect of the induced charge from holes and the hole-trapping problem common in compound semiconductors or other ionization detectors becomes insignificant. The analysis of the frequency dependent signal measured by the antenna array produces a detector with energy resolution. The detector can be configured with additional analysis to provide one, two or three dimensional event position readout in addition to the energy measurement.

The average drift distance before trapping, d', is given by $d'=\mu\cdot\tau\cdot E$, where $\mu$ and $\tau$ are the carrier mobility and lifetime, respectively, and E is the electrical field strength. Detrapping and retrapping may occur, increasing the effective carrier lifetime $\tau$. A range of AC frequencies and applied voltages can be utilized by the system. A preferred range depends on the material and physical configuration and detector size. Guided by the relationship, $d'=\mu\cdot\tau\cdot E$, the frequency and applied voltage are selected to provide a travel distance less than d' for multiple oscillations of the principal charge carrier. If an antenna array is used then the applied voltage and frequency, in one embodiment, should also produce a travel distance for a single oscillation less than about the spacing of the antenna grid.

In one embodiment the depth of gamma-ray interaction between opposing antenna or antenna arrays 102 can be obtained by using the ratio of the signals from antenna grids 102 on opposite sides of the detector 100. In another embodiment a bias voltage can be applied across the opposing antenna or antenna arrays and depth can be deduced from the transport time from the onset of oscillation signal to the termination of oscillation signal by collection of the charge at the antenna array. The employment of depth sensing improves spectroscopic response when using large volume detectors.

The position of interaction within the detector in the direction that this perpendicular to the antenna array can be obtained by analyzing where within the antenna array the polarity of induced charge changes. Within the array at one point the charge is moving towards some antenna elements and away from other antenna elements. The sign of the induced charge changes according to whether the charge is moving towards or away from each specific antenna element.

The amplitude of the induced charge on each antenna element also is position dependent and provided information on the event location in the direction perpendicular to the antenna array.

To acquire event location in the direction along the antenna 102, the DC bias voltage 300 could be applied across the detector in the direction along the antenna array. The event position is calculated from the time the event signal begins to when the event signal terminates.

The output provides for a 3-dimensional identification of the event location, providing x, y, z and E (energy) information critical to the new generation of gamma ray detection systems. An evaluation of event location can be achieved. Depth from the antenna arrays will be expressed as a differentiation between the signal patterns measured on the two sides of the detector containing the antenna arrays. Position along the antenna array can be determined by measuring the charge transit time from the first induced signal to arrival of charge at the anode. Position across the antenna array can be determined by analyzing the antenna signal patterns on either side of the detector.

On a detector 100 an antenna array 102 is employed. With this arrangement, the signal induced on the antenna is mainly proportional to the number of electrons moving in the material. The induced charge from holes is greatly reduced because the mobility for holes is an order of magnitude smaller than that for electrons, and thus the hole-trapping problem in compound semiconductors can be overcome. The depth of gamma-ray interaction can be obtained by using the ratio and distribution of the signals from opposite sides of the detector. The employment of depth sensing improves spectroscopic response when using large volume detectors. This depth sensing provides the depth of interaction necessary to reach high resolution in laboratory experiments. The individual depths are combined to get an overall spectrum for the pixel. Using a technique where the peak centroid from each individual depth is lined up under the same channel, high resolution can be realized.

Events may occur where two distinct interaction points are simultaneously present in the detector. These are events caused by, for example, either two gamma rays interacting within the detector at the same time, or by Compton scatter of a gamma rays with subsequent absorption of the scattered photon. These are important cases to analyze. Event timing among the signals provides information on how to handle these events. Evaluation of the timing properties can be used to differentiate multiple interaction events. To account for Compton scatter events with subsequent absorption of the scattered photon, timing data from the two signals is simultaneous (to within the transport time of the Compton scatter photon to the secondary interaction point).

If some electron trapping has occurred (which is possible for thick detectors) a correction factor can be applied to the data. Noting changes in signal strength with transport will give an indication of any electron trapping effects.

Corrections due to depth dependent factors (charge trapping and material non-uniformity) may be performed by establishing a look up table of multiplicative and/or additive correction factors that can be applied to a position dependent energy analysis.

The above description discloses the invention including preferred embodiments thereof. The examples and embodiments disclosed herein are to be construed as merely illustrative and not a limitation of the scope of the present invention in any way. It will be obvious to those having skill in the art that many changes may be made to the details of the above-described embodiments without departing from the underlying principles of the invention.

What is claimed is:

1. An ionization detector, comprising:

a detector body in which charge carriers are produced by absorption of radiation;

said detector body having a first face;

an electrode on said first face of said detector body;

said detector body having a second face substantially perpendicular to said first face;

said detector body having a third face substantially perpendicular to said first face and substantially parallel to said second face;

a second electrode formed on said second face of said detector body;

a third electrode formed on said third face of said detector body; said detector body having a fourth face substantially perpendicular to said first face and substantially perpendicular to said second face;

said detector body having a fifth face substantially perpendicular to said first face and substantially parallel to said fourth face;

a fourth electrode formed on said fourth face of said detector body; a fifth electrode formed on said fifth face of said detector body;

a DC bias voltage source connected between said fourth electrode and said fifth electrode to apply a bias voltage across the detector body to separate and collect the charge carriers by polarity;

an AC voltage source connected between the second electrode and said third electrode to apply an oscillating voltage to oscillate charge carriers within said detector body;

a readout device connected to said electrode on said first face.

2. The detector of claim 1 wherein said detector body is formed of a semiconductor material.

3. The detector of claim 2 wherein said semiconductor material is Cadmium Zinc Telluride.

4. The detector of claim 1 wherein said detector body is a liquid or gas filled chamber.

5. The detector of claim 4 wherein said detector body contains a Nobel gas.

6. The detector of claim 1 wherein the AC voltage source is operating at an oscillation frequency greater than 1,000 Hz.

7. The detector of claim 1 wherein the AC voltage source is operating at an oscillation frequency greater than 10,000 Hz.

8. The detector of claim 1 wherein the AC voltage source is operating at an oscillation frequency greater than 100,000 Hz.

9. The detector of claim 1 wherein said electrode on said first face of said detector body is an array of electrodes on said first face.

10. The detector of claim 1 wherein said readout device connected to said electrode on said first face is a Flash ADC.

11. An ionization detector, comprising:

a detector body in which charge carriers are produced by absorption of radiation;

said detector body having a first face;

a first electrode on said first face of said detector body;

said detector body having a second face substantially perpendicular to said first face;

said detector body having a third face substantially perpendicular to said first face and substantially parallel to said second face;

a second electrode formed on said second face of said detector body;

a third electrode formed on said third face of said detector body;

said detector body having a fourth face substantially parallel to said first lace and substantially perpendicular to said second face;

a fourth electrode formed on said fourth face of said detector body;

a DC bias voltage source connected between said first electrode and said fourth electrode to apply a bias voltage across the detector body to separate and collect the charge carders by polarity;

an AC voltage source connected between said second electrode and said third electrode to apply an oscillating voltage to oscillate charge carriers within said detector body;

a first readout device connected to said first electrode.

12. The detector of claim 11 wherein said first electrode on said first face and said fourth electrode on said fourth face are arrays of electrodes.

13. The detector of claim 11 further comprising a second readout device connected to said fourth electrode.

14. An ionization detector, comprising:

a detector body in which charge carriers are produced by absorption of radiation;

said detector body having a first face;

a first electrode array on said first face of said detector body;

said detector body having a second face substantially perpendicular to said first face;

said detector body having a third face substantially perpendicular to said first face and substantially parallel to said second face;

a second electrode formed on said second face of said detector body;

a third electrode formed on said third face of said detector body;

an AC voltage source connected between said second electrode and said third electrode to apply an oscillating voltage to oscillate charge carriers within said detector body;

a readout device connected to said first electrode array.

15. The detector of claim 14 further comprising a DC bias voltage source connected between said second electrode and said third electrode to apply a bias voltage across the detector body to separate and collect the charge carriers by polarity.

16. A method for detecting ionizing radiation, comprising:

absorbing radiation in a detector body to produce charge carriers;

said detector body having an electrode array on one surface thereof;

said detector body having a first pair of coplanar electrodes on surfaces perpendicular to said electrode array;

applying an oscillatory voltage across said pair of coplanar electrodes; and detecting an oscillatory induced charge signal from said electrode array.

17. The method of claim 16 further comprising;

said detector body having a second the pair coplanar electrodes on surfaces perpendicular to said electrode array and perpendicular to said first pair of coplanar electrodes;

applying a bias voltage across said second pair of coplanar electrodes.

18. The method of claim 17 further comprising;

analyzing said oscillatory charge signal using a frequency domain technique.

19. The method of claim 18 wherein said frequency domain technique is Fourier transform.

* * * * *